United States Patent [19]

Kobayashi et al.

[11] Patent Number: 5,046,976

[45] Date of Patent: Sep. 10, 1991

[54] COWLING AND AIR INTAKE DUCT FOR OUTBOARD MOTOR

[75] Inventors: Seiji Kobayashi; Masaharu Miyazaki, both of Hamamatsu, Japan

[73] Assignee: Sanshin Kogyo Kabushiki Kaisha, Hamamatsu, Japan

[21] Appl. No.: 463,394

[22] Filed: Jan. 11, 1990

[30] Foreign Application Priority Data

Jan. 12, 1989 [JP] Japan ..... 1-3773

[51] Int. Cl.[5] ..... B63H 21/24

[52] U.S. Cl. ..... 440/77; 123/195 P

[58] Field of Search ..... 440/77, 88; 123/195 P

[56] References Cited

U.S. PATENT DOCUMENTS 3,610,198 10/1971 Alexandrowicz ..... 123/195 P
4,379,702 4/1983 Takada et al. ..... 440/77
4,403,971 9/1983 Kobayashi et al. ..... 440/88
4,571,193 2/1986 Takada et al. ..... 440/77
4,867,120 9/1989 Boda et al. ..... 123/195 P

*Primary Examiner*—Jesûs D. Sotelo
*Attorney, Agent, or Firm*—Ernest A. Beutler

[57] ABSTRACT

A cowling and air intake device is provided for the powerhead of an outboard motor which includes an air intake duct with a downwardly facing opening. The duct is mounted within an air inlet cavity formed within an upper rear portion of the cowling. A cover is secured to the cowling to form the top surface of the air inlet and to cover the intake duct. The air inlet inducts air from the atmosphere through a rearwardly facing opening wherein the air is drawn up into the intake duct for supply to the induction system of the outboard motor's internal combustion engine. The downwardly facing intake duct insures that water will not enter into the interior of the cowling or into the engine induction system.

7 Claims, 4 Drawing Sheets

COWLING AND AIR INTAKE DUCT FOR OUTBOARD MOTOR

BACKGROUND OF THE INVENTION

This invention relates to a cowling for an outboard motor, and more particularly to an improved protective cowling and air intake duct for the powerhead of an outboard motor.

It is well known with outboard motors that the powering internal combustion engine is normally enclosed within a protective cowling so as to provide protection for the internal combustion engine and a better appearance for the outboard motor. The protective cowling defines a cavity in which the internal combustion engine is contained. It is also well known that the engine must be supplied with copious amounts of air for the engine induction system. Conventionally, the protective cowling includes an air inlet positioned in the upper rear portion thereof. This air inlet generally defines a recess within the cowling and has an upwardly and rearwardly facing opening and may have sidewardly facing openings as well to permit air to flow into the recess. See for example U.S. Pat. No. 4,571,193. Typically air intake means are provided in the form of ducts or ports which are formed within the air inlet for supplying air to the engine induction system. Previously, such air intake means have had upwardly facing air intake openings See for example U.S. Pat. Nos. 4,379,702 and 4,403,971.

These types of intake ducts are normally incorporated so that under normal operating conditions water will not enter into the interior of the cowling or into the engine induction system. A cover is typically positioned upward of the air intake duct and spaced therefrom so as to permit air to enter the duct but to stop rain or splashes of water from falling directly into the duct opening. However, under some conditions the cover may not be particularly effective in stopping water which is carried into the air inlet through an opening from entering into the intake duct, and hence, into the interior of the protective cowling. Once inside the cowling the water can damage the engine and the electrical parts of the outboard motor or enter the induction system of the engine. Such an air intake duct with an upwardly facing opening can be susceptible to the entry of water in the form of splashes which result when a wave strikes the rear of the marine vessel and outboard motor. This arrangement also makes it possible for water adhering on the under surface of the cover to fall into the duct opening.

It is, therefore, a principal object of this invention to provide an improved cowling and air inlet device for the powerhead of an outboard motor which will insure that the water cannot enter the engine induction system or the cavity which surrounds the engine.

SUMMARY OF THE INVENTION

A cowling and air inlet device is provided for the powerhead of an outboard motor having an internal combustion engine including an induction system. The cowling and air inlet device comprises air inlet means for inducting air from the atmosphere formed in an upper rear surface of the cowling. The invention further includes air intake means, preferably in the form of a duct, having a downwardly facing air intake opening and mounted within the air inlet means for supplying air to the induction system. A cover is secured to the cowling for covering the air intake means and for forming a top surface of the air inlet means so as to cooperate in defining a flow path for air into the air inlet means.

DETAILED DESCRIPTION OF THE PREFERRED EMBODIMENT

Figure 1:
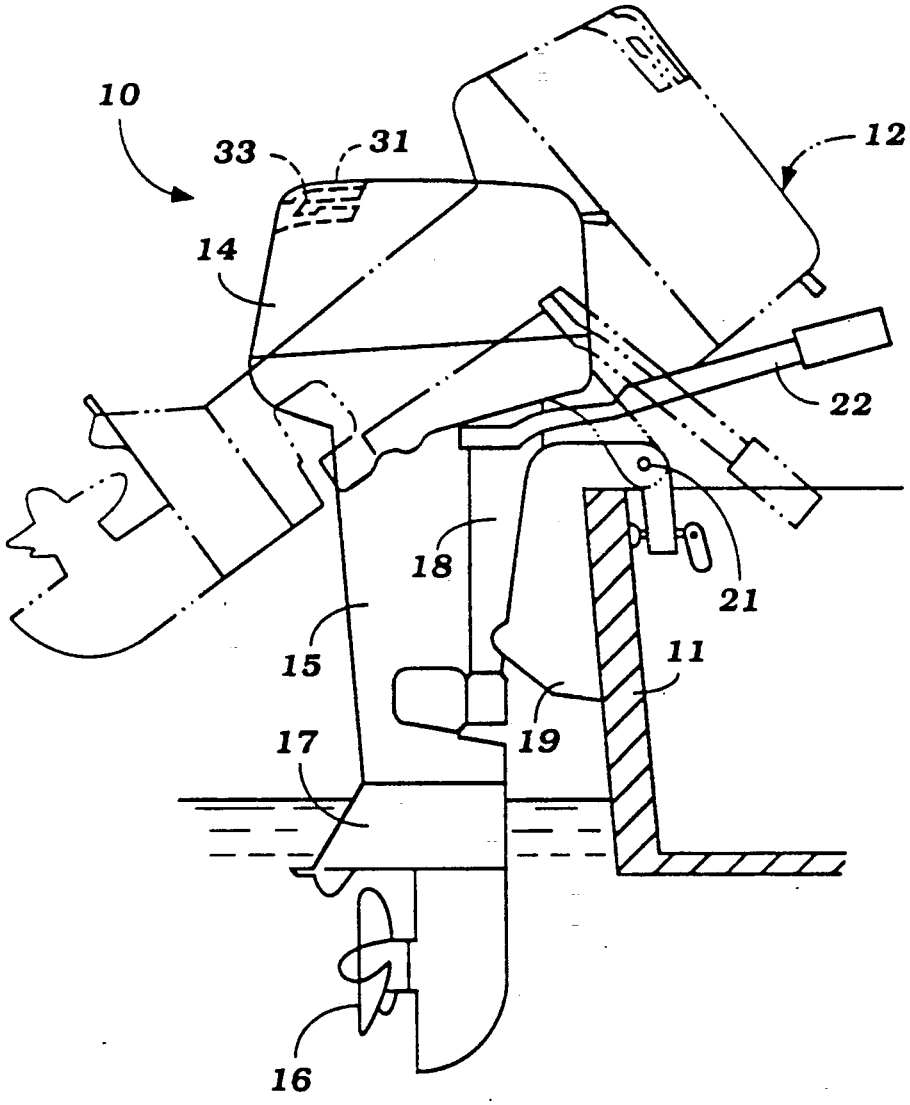
FIG. 1 is a side elevational view of an outboard motor constructed in accordance with this invention.

Referring first to FIG. 1, an outboard motor constructed in accordance with the invention is identified generally by the reference numeral 10 and is shown as attached to a transom 11 of an associated watercraft. The outboard motor 10 includes a powerhead, indicated generally by the reference numeral 12, that contains an internal combustion engine 13 (see FIG. 2) and which is surrounded by a protective cowling 14 having an air inlet device constructed in accordance with the invention. The internal combustion engine 13 drives an output shaft which., in turn, drives a driveshaft that is journalled for rotation within a driveshaft housing 15 that depends from the powerhead 12. This driveshaft (not shown) drives a propeller 16 of a lower unit 17 by means of a conventional forward, reverse, neutral transmission (not shown).

A steering shaft is affixed to the driveshaft housing 15 in a known manner and is supported for steering movement about a generally vertically extending steering axis within a swivel bracket assembly 18. The swivel bracket assembly 18 is, in turn, pivotally connected to a clamping bracket 19 by means of a tilt shaft 21 for tilt and trim movement of the outboard motor 10. The clamping bracket 19 includes means for affixing the outboard motor 10 to the transom 11 of the watercraft. A tiller 22 extends from the steering shaft toward the watercraft for steering the outboard motor 10.

The construction of the outboard motor 10 as thus far described may be considered conventional and, for that reason, those components which are not illustrated and which have not been described in any more detail may take the form of any of the known components used in this field.

Figure 2:
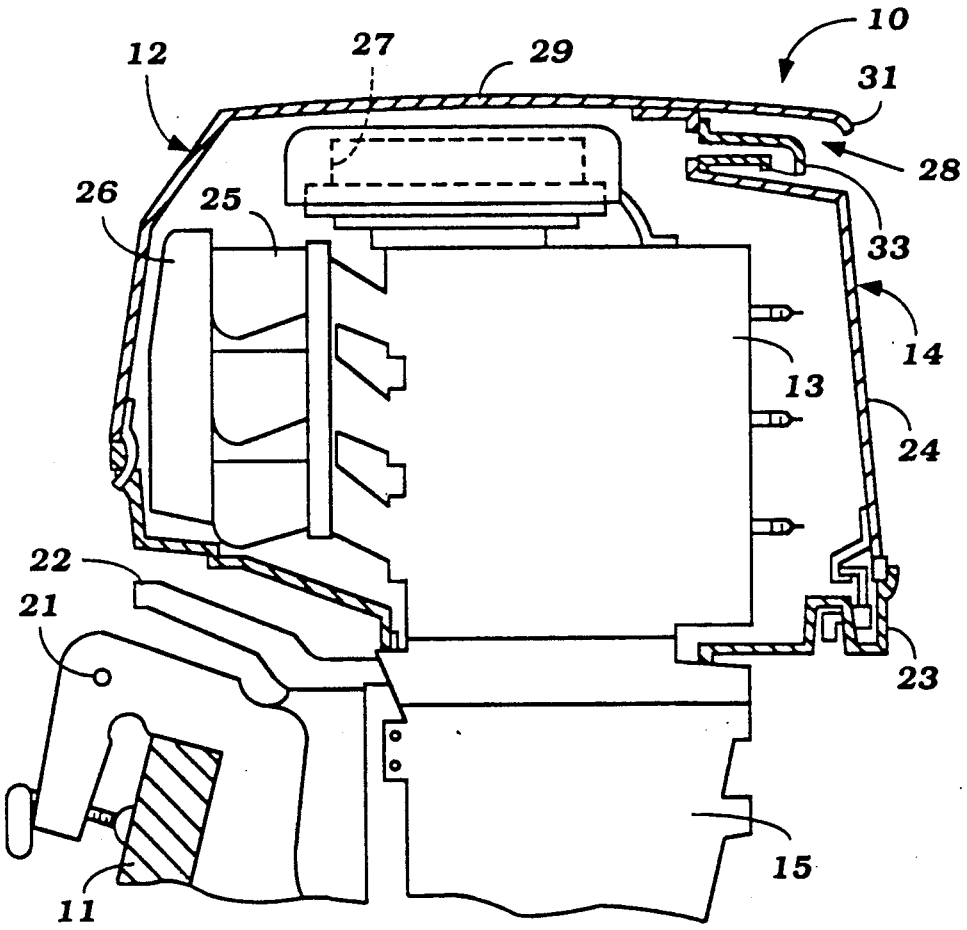
FIG. 2 is an enlarged cross sectional view of the powerhead of the outboard motor showing the cowling construction and air intake duct of this invention.

Referring now to FIG. 2, the protective cowling 14 of the powerhead 12 is comprised of a tray or bottom cowling 23 that is affixed to the lower end of the internal combustion engine 13 and a top cover indicated by the reference numeral 24 and typically formed from a lightweight plastic material The top cover 24 has a generally inverted cup shape and carried a pair of latch keepers that are formed at the lower end thereof for cooperation with releasable latch mechanisms carried by the tray 23 for detachably affixing the top cover 24 and tray 23 to each other. When so affixed, this top cover 24 defines a cavity in which the internal combustion engine 13 and its associated parts including carburetors 25, and flywheel magneto 27 are contained.

The engine 13 contained within the cavity also includes an induction system having an air intake device 26 and air must be supplied to this induction system and intake device 26 through a suitable inlet since the top cover 24 generally fully encloses the internal combustion engine 13. There is, therefore, formed air inlet means 28 in an upper rear surface of the top cover 24 defining a recess therein and having a rearwardly facing opening. The air inlet means 28 has sufficient flow area so as to adequately serve the induction system needs of the internal combustion engine 13 of the powerhead 12.

Figure 3:
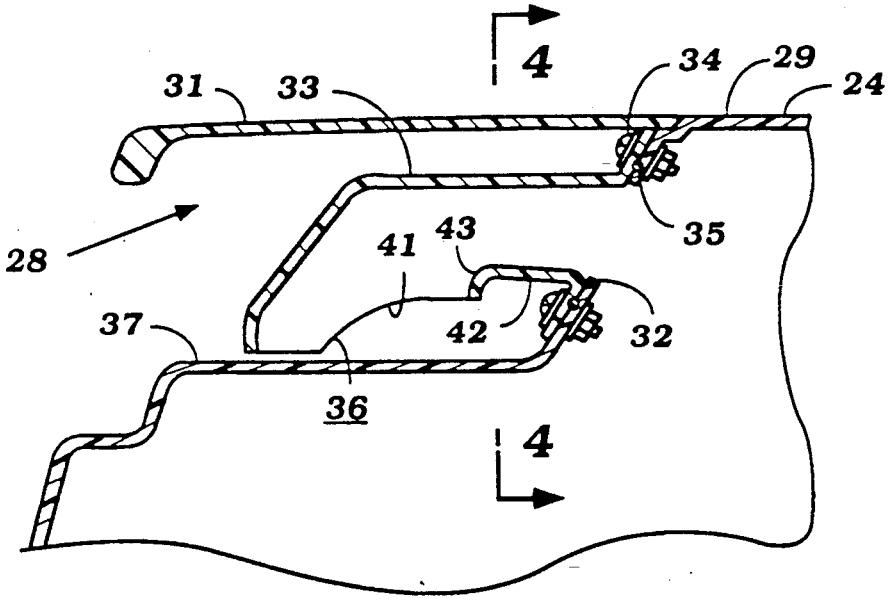
FIG. 3 is an enlarged cross sectional view showing the details and structure of the air intake duct of this invention.
Figure 4:
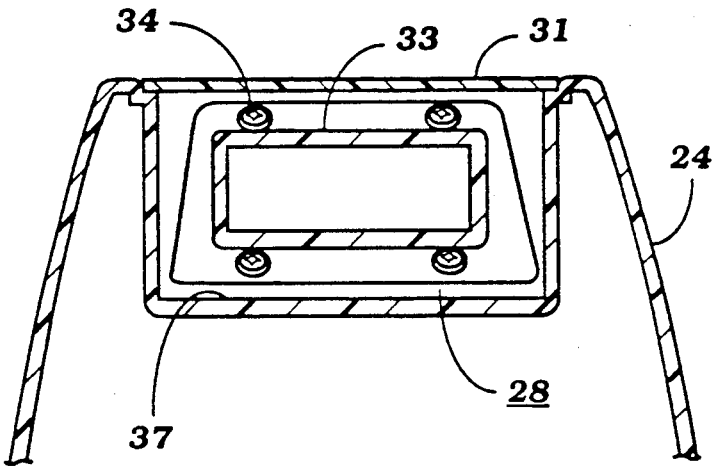
FIG. 4 is a rear cross sectional view of the air intake duct taken along line IV—IV of FIG. 3.

Referring now to FIGS. 2 through 4, the top cover 24 includes a top member 29 also formed from a lightweight plastic material which defines a substantial part of the top surface of the top cover 24. A duct cover 31 is secured or molded to the top member 29 so that it lies substantially in the same plane as top member 29. This arrangement provides a uniform and continuous appearing top surface when the parts are assembled together The cover 31 also forms the top of the air inlet means 28 so as to cooperate in defining a flow path for air which is inducted from the atmosphere into the air inlet means 28.

An air outlet 32 is formed in a front wall of the air inlet means 28 wherein air enters into the interior of the cowling 14 for supply to the air induction system. An air intake duct 33 is mounted on the front wall of the air inlet means 28 around the air outlet 32 by bolts 34 or other suitable means. When so mounted, the duct 33 communicates with the air outlet 32 and provides a flow path for air from the air inlet means 28 into the interior of the cowling 14. An 0-ring 35 surrounds the air outlet 32 and sealingly engages with the front wall of the air inlet means 28 and the adjoining end of the air intake duct 33 so as to provide a watertight seal around the outlet 32 when the air intake duct 33 is secured to the front wall of the air inlet means 28. The duct 33 includes a top wall and a bottom wall 42 and two (2) side walls which surround its hollow interior and extend rearwardly and then downwardly within the air inlet means 28 to define a downwardly facing air intake opening 36. The duct 33 supplies air to the induction system of the internal combustion engine 13.

In operation of the outboard motor engine 13, atmospheric air is drawn through the opening of the air inlet means 28 and into the air inlet means 28 where the air expands. The air is then drawn up through the downwardly facing air intake opening 36 into the air intake duct 33. Because the air flows in a generally horizontal direction into the air inlet means 28 and then turns upward to flow into the air intake duct 33, water carried in the air from spray, splashes or rain can ordinarily be separated from the air before the air enters the duct 33. This separation is the result, at least in part, of the upward turn the inlet air must take to enter the air intake duct 33. The entrained water droplets having a larger inertia than the air do not follow the upward turn of the air. Instead, the separated water will adhere to a bottom surface 37 of the air inlet means 28 which is positioned beneath the air intake opening 36 and in close proximity thereto. Gravity precludes the entrained water from entering the air inlet duct 33 as well, and also stops water which adheres to the bottom surface 37 from entering the duct 33.

To further prevent water from being inducted up through the air intake opening 36, the sidewalls of the duct 33 are formed with opposing arcuate recesses 41. These arcuate recesses 41 serve to maintain a low air flow velocity, since water entrained in fast moving air is more likely to enter the air intake opening 36. The arcuate recesses 41 sufficiently increase the surface area of the air intake opening 36 and also increase the gap between the opening 36 and the bottom surface 37 of the air inlet opening 36 so as to prevent the air inlet velocity from increasing rapidly and becoming too high.

The bottom wall 42 of the duct 33, which extends in a generally horizontal and rearward direction from the air outlet 32, is bent downward at its rearward end. This downwardly extending segment 43 forms the forward portion of the air intake opening 36. When the outboard motor is in the tilted-up position as shown in broken lines in FIG. I, the downwardly extending segment 43 stops water, particularly rain water, which has entered into the air inlet means 28 and accumulated around the opening 36 from passing through the air outlet 32 into the interior of the cowling 14.

By providing an air intake duct 33 with a downwardly facing opening 36, this invention also prevents any water adhering on the underside of the duct cover 31 from falling into the duct opening 36 as may happen when an upwardly facing intake duct is used. This invention further prevents water from entering the interior of the cowling 14 when a wave strikes the back of the outboard motor 10, which typically results from rapid deceleration of the watercraft.

It should be readily apparent from the foregoing description that this invention is highly effective in providing adequate air flow for the internal combustion engine without the likelihood of water entering the engine induction system or the cavity which surrounds the engine. Although, this is the case, various changes and modifications may be made without departing from the spirit and scope of the invention, as defined by the appended claims.

We claim:

1. A cowling and air inlet device for the powerhead of an outboard motor having an internal combustion engine including an induction system, comprising air inlet means for inducting air from the atmosphere formed in an upper rear surface of said cowling, air intake means having an air intake opening and mounted within said air inlet means for supplying air to said induction system, and a cover secured to said cowling for covering said air intake means and for forming a top surface of said air inlet means to cooperate in defining a flow path for air into said air inlet means, and wherein the air intake opening is downwardly facing so as to prevent any water adhering on the underside of said cover from falling into the air intake opening.

2. A cowling and air inlet device as recited in claim 1, wherein said air intake means comprises an air intake duct.

3. A cowling and air inlet device as recited in claim 2, wherein said air inlet means further comprises a front wall having an air outlet therein, said air intake duct being mounted on the front wall for communication with said air outlet.

4. A cowling and air inlet device as recited in claim 3, further comprising means for sealingly engaging said intake duct and the front wall of said air inlet means so as to provide a water tight seal around said air outlet.

5. A cowling and air inlet device as recited in claim 4, wherein said air inlet means further comprises a bottom surface positioned beneath the air intake opening and in close proximity thereto so that water entering said air inlet means may adhere to said bottom surface.

6. A cowling and air inlet device as recited in claim 5, wherein said air intake duct comprises a pair of side walls having opposing arcuate recesses formed therein to increase the surface area of the air intake opening and to increase the gap between the air intake opening and said bottom surface so as to prevent the velocity of the inducted air from rapidly increasing.

7. A cowling and air inlet device as recited in claim 6, wherein said air intake duct comprises a bottom wall having a downwardly extending segment at its rearward end which forms the forward portion of the air intake opening, said downwardly extending segment being adapted to stop water which has accumulated around the air intake opening from passing through said air outlet.

* * * * *